US010507396B2

(12) United States Patent
Liu et al.

(10) Patent No.: US 10,507,396 B2
(45) Date of Patent: Dec. 17, 2019

(54) AMUSEMENT DEVICE FOR ASCENDING, BACKWARDS RUSHING AND FALLING

(71) Applicant: GOLDEN HORSE TECHNOLOGY ENTERTAINMENT CORP., LTD, Zhongshan (CN)

(72) Inventors: Xiwang Liu, Zhongshan (CN); Xiongwei Liang, Zhongshan (CN); Yingqiang Liu, Zhongshan (CN); Peixun Peng, Zhongshan (CN); Pinlun Huang, Zhongshan (CN)

(73) Assignee: GOLDEN HORSE TECHNOLOGY ENTERTAINMENT CORP., LTD., Guangdong (CN)

( * ) Notice: Subject to any disclaimer, the term of this patent is extended or adjusted under 35 U.S.C. 154(b) by 0 days.

(21) Appl. No.: 16/302,247

(22) PCT Filed: Apr. 4, 2018

(86) PCT No.: PCT/CN2018/081882

§ 371 (c)(1),
(2) Date: Nov. 16, 2018

(87) PCT Pub. No.: WO2019/056730

PCT Pub. Date: Mar. 28, 2019

(65) Prior Publication Data

US 2019/0224578 A1 Jul. 25, 2019

(30) Foreign Application Priority Data

Sep. 25, 2017 (CN) ..... 2017 1 0871637

(51) Int. Cl.

| | |
|---|---|
| ***A63G 31/00*** | (2006.01) |
| ***A63G 31/02*** | (2006.01) |
| ***A63G 23/00*** | (2006.01) |

(52) U.S. Cl.
CPC ..... *A63G 31/007* (2013.01); *A63G 23/00* (2013.01); *A63G 31/00* (2013.01); *A63G 31/02* (2013.01); *A63G 2031/002* (2013.01)

(58) Field of Classification Search
CPC ..... A63G 7/00; A63G 21/00; A63G 21/18; A63G 31/00; A63G 31/007
(Continued)

(56) References Cited

U.S. PATENT DOCUMENTS 5,704,294 A * 1/1998 Van Winkle ..... A63C 19/00 104/60

FOREIGN PATENT DOCUMENTS

CN 202185151 U 4/2012
CN 104027979 A 9/2014
(Continued)

OTHER PUBLICATIONS

Jun. 15, 2018 International Search Report issued in International Patent Application No. PCT/CN2018/081882.
(Continued)

*Primary Examiner* — Kien T Nguyen
(74) *Attorney, Agent, or Firm* — Oliff PLC

(57) ABSTRACT

An amusement device for ascending, backwards rushing and falling includes a lifting tower, the lower part of the lifting tower having an entry section and the upper part having a lifting slide-out section, an amusement ship entering the lifting tower by the bow through the entry section and then leaving the lifting tower by the stern through the lifting slide-out section in the same direction, and the entry section and the lifting slide-out section being in the same direction; and a descending tower, the upper part of the descending tower having a descending entry section and the lower part having a descending slide-out section, the amusement ship entering the descending tower through the descending entry
(Continued)

section and then leaving the descending tower through the descending slide-out section in the same direction, and the descending entry section and the descending slide-out section being in the same direction.

9 Claims, 3 Drawing Sheets

(58) Field of Classification Search
USPC ..... 472/2, 117, 128, 131; 446/444
See application file for complete search history.

(56) References Cited

FOREIGN PATENT DOCUMENTS

| | | | |
|---|---|---|---|
| CN | 105377386 | A | 3/2016 |
| CN | 107441717 | A | 12/2017 |
| CN | 207401129 | U | 5/2018 |
| DE | 20316695 | U1 | 3/2005 |
| EP | 1757348 | B1 | 8/2007 |

OTHER PUBLICATIONS

Jun. 14, 2018 Written Opinion issued in International Patent Application No. PCT/CN2018/081882.
Feb. 1, 2019 Office Action issued in Chinese Patent Application No. 201710871637.1.

* cited by examiner

AMUSEMENT DEVICE FOR ASCENDING, BACKWARDS RUSHING AND FALLING

TECHNICAL FIELD

The present invention relates to amusement device for ascending, backwards rushing and falling.

BACKGROUND ART

Sliding type amusement machines currently available in the market only have limited ways to play, some of which can only climb and down-thrust, and some can only slide in a curved path. Generally, there are the following types:

Pirate Ship Amusement Machine, which is of a horizontal axis reciprocating swing type, passengers ride thereon and swing back and forth at first slowly and then fast, just like in a stormy sea, one minute you are on the crest of a wave, and the next minute you fall to the bottom of a valley, thrilling and exciting, and extremely entertaining.

Crescent Floating Car, which belongs to track type amusement equipment and is also called Crescent Mushroom, Time Surfing and Crescent Mushroom Floating Car. A track of the Crescent Floating Car is brightly colored, and as the car runs up and down on the track, passengers can have a feeling of tramping over hill and dale.

And Mini-Coaster, suitable for children over 1.2 m tall and adults to ride on. The movement feature of Mini-Coaster is that circular rotation and sliding along a track are integrated, moreover, Mini-Coaster is beautiful in appearance and bright in color and suitable for various places such as playground, park, squares and cultural center.

The above sliding type amusement machines only have limited ways to play, not novel in design and poor in interestingness, thus can no longer meet the demand of people for stronger excitement.

SUMMARY OF THE INVENTION

The object of the invention is to overcome the defects of the prior art and provide amusement device for ascending, backwards rushing and falling with varied gameplay, novel design, more variety and strong interest.

The object of the invention is achieved as follows:

Amusement device for ascending, backwards rushing and falling, comprising:

a lifting tower, the lower part of the lifting tower being provided with an entry section, the upper part of the lifting tower being provided with a lifting slide-out section, an amusement ship entering the lifting tower by the bow through the entry section and then leaving the lifting tower by the stern through the lifting slide-out section to return in the same direction, and the entry section and the lifting slide-out section being in the same direction;

and a descending tower, the upper part of the descending tower being provided with a descending entry section, the lower part of the descending tower being provided with a descending slide-out section, the amusement ship entering the descending tower through the descending entry section and then leaving the descending tower through the descending slide-out section to return in the same direction, and the descending entry section and the descending slide-out section being in the same direction.

In the amusement device for ascending, backwards rushing and falling, the center line of the entry section coincides with the center line of the lifting slide-out section.

In the amusement device for ascending, backwards rushing and falling, the center line of the descending entry section coincides with the center line of the descending slide-out section.

In the amusement device for ascending, backwards rushing and falling, the amusement ship comprises a ship body, a chassis provided with rollers is disposed under the ship body.

In the amusement device for ascending, backwards rushing and falling, the lifting tower comprises a tower frame, wherein a lifting base for lifting the amusement ship and a driving mechanism for driving the lifting base to rise are arranged on the tower frame; and the lifting tower also comprises an anti-overturning mechanism for preventing the amusement ship from overturning and an anti-falling safety mechanism for preventing the amusement ship from falling.

In the amusement device for ascending, backwards rushing and falling, the entry section comprises an auxiliary lifting tower frame which is provided with an auxiliary lifting guide rail/auxiliary lifting guide rails for the amusement ship to slide thereon, and the auxiliary lifting tower frame slides/the auxiliary lifting tower frame slide upward from a starting end to an end connected with a lifting tower system.

In the amusement device for ascending, backwards rushing and falling, the entry section is a water flow passage passing through the lower part of the lifting tower, and water flow with a certain flow speed which can drive the amusement ship to enter the lower part of the lifting tower flows in the water flow passage.

In the amusement device for ascending, backwards rushing and falling, the lifting slide-out section comprises a backwards-rushing frame connected with the upper end of the lifting tower system, and the backwards-rushing frame is provided with a backwards-rushing guide rail/backwards-rushing guide rails.

In the amusement device for ascending, backwards rushing and falling, the descending tower comprises a descending frame, and the descending frame is provided with a sliding frame capable of falling on the descending frame and a driving unit for driving the sliding frame to fall.

In the amusement device for ascending, backwards rushing and falling, the descending entry section comprises a descending entry frame provided with a descending entry guide rail/descending entry guide rails for the amusement ship to slide thereon, and the descending entry frame is linearly arranged from the starting end to the end connected with the descending tower; and the descending slide-out section comprises a descending slide-out frame provided with a slide-out guide rail/slide-out guide rails for the amusement ship to slide thereon, and the descending slide-out frame is arranged in a descending manner from the end connected with the descending tower to the end away from the descending tower.

According to the invention, with players being seated thereon, the amusement ship may enter the lifting tower by the bow through the entry section, and then leave the lifting tower by the stern through the lifting slide-out section after being lifted to a certain height by the lifting tower, so as to return in the same direction; then the amusement ship enters the descending tower through the descending entry section and leaves the descending tower through the descending slide-out section after the amusement ship falls to a certain height from the descending tower, so as to return in the same direction; in this way, an innovative ascending, backwards-rushing and falling playing method is realized. The tower frame of the invention slides up and down vertically in a straight line, so that the amusement ship can be lifted vertically in a straight line on the tower frame. The descending frame of the invention slides up and down vertically in a straight line, so that the amusement ship can fall vertically in a straight line on the descending frame. In this way, different experiences of vertical lifting and vertical falling can be obtained, which greatly improves the amusement experience of players with various playing methods; and the design is novel, diversified playing methods are available, and interestingness is enhanced.

DETAILED DESCRIPTION OF THE INVENTION

Figure 1:
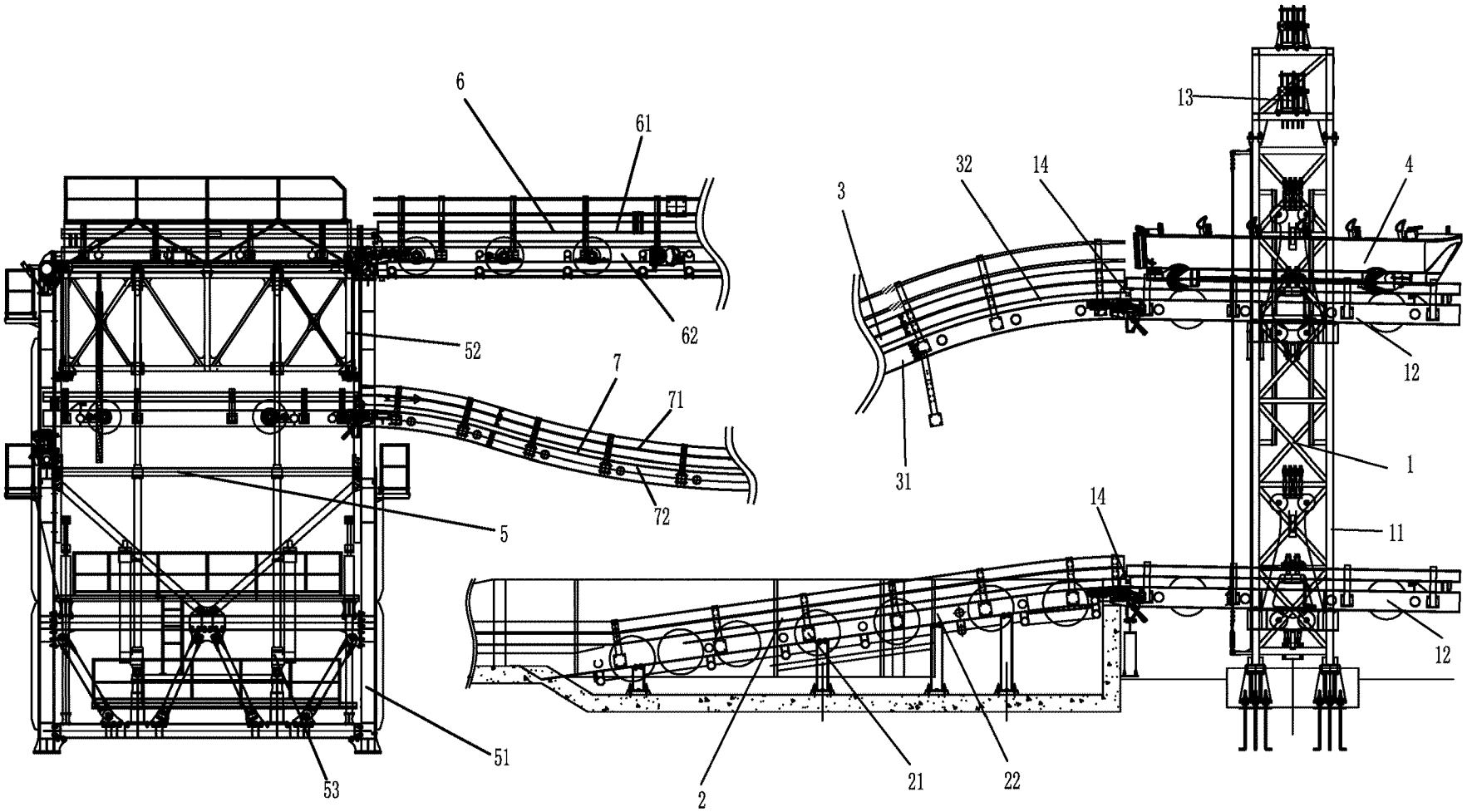
FIG. 1 is a structural diagram of the present invention.
Figure 2:
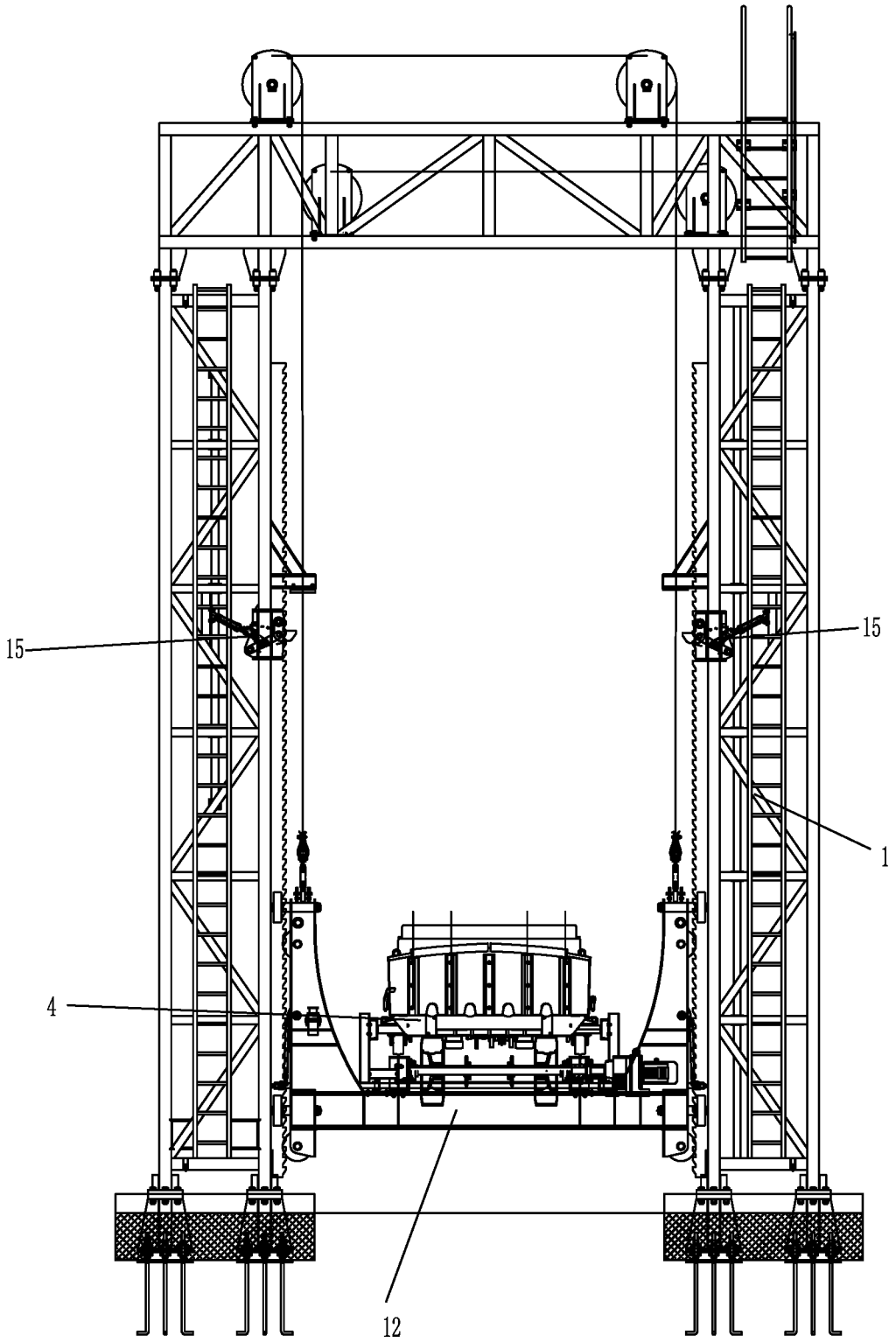
FIG. 2 is a structural diagram of a lifting tower of the present invention.
Figure 3:
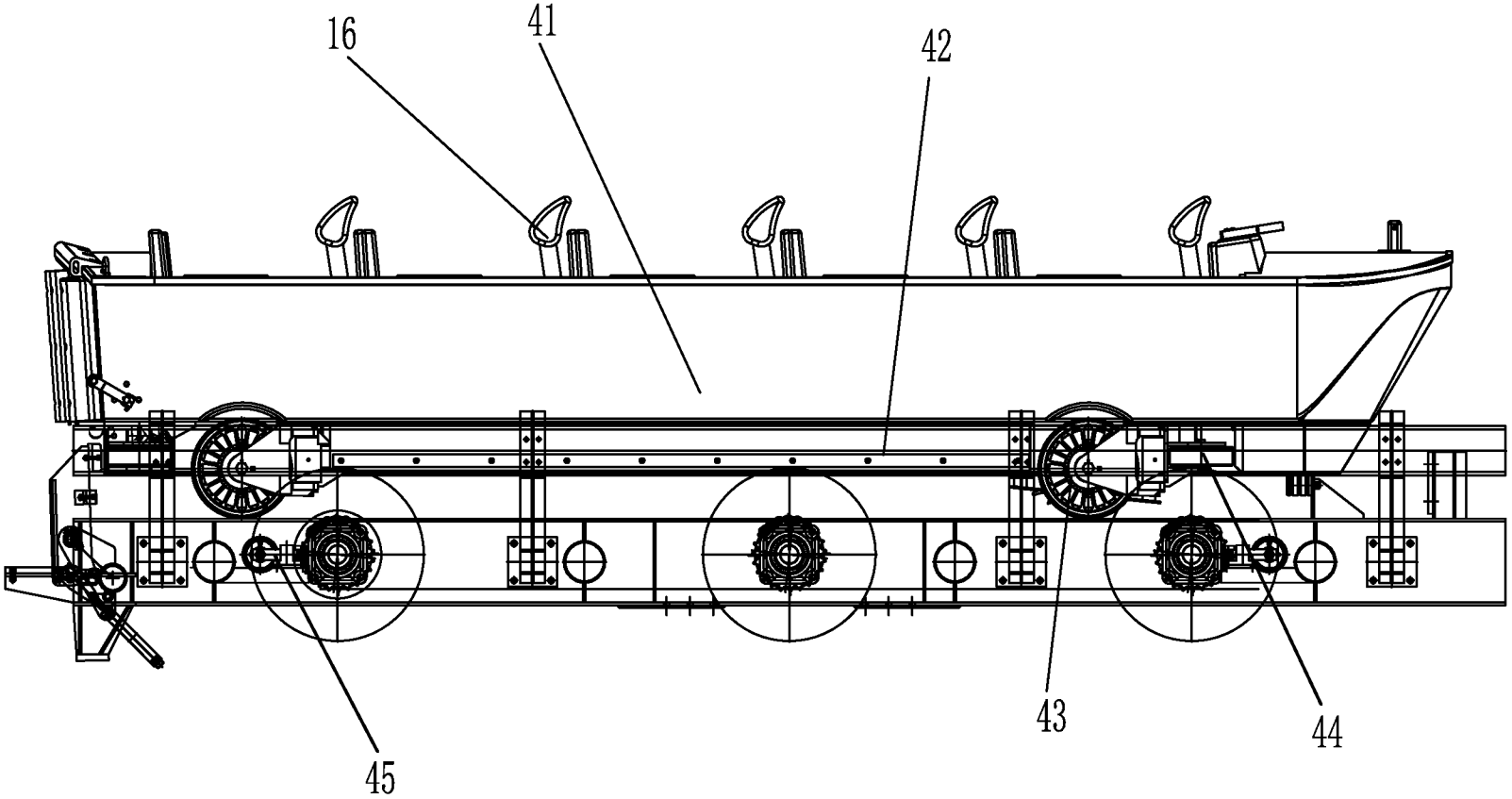
FIG. 3 is a structural diagram of an amusement ship of the present invention.

The present invention will be further described with reference to the drawings:

An amusement device for ascending, backwards rushing and falling, comprising:

a lifting tower 1, the lower part of the lifting tower 1 being provided with an entry section 2, the upper part of the lifting tower 1 being provided with a lifting slide-out section 3, an amusement ship 4 entering the lifting tower 1 by the bow through the entry section 2 and then leaving the lifting tower 1 by the stern through the lifting slide-out section 3 to return in the same direction, and the entry section 2 and the lifting slide-out section 3 being in the same direction; and a descending tower 5, the amusement ship 4 leaving the lifting tower 1 and then entering the descending tower 5, the upper part of the descending tower 5 being provided with a descending entry section 6, the lower part of the descending tower 5 being provided with a descending slide-out section 7, the amusement ship 4 entering the descending tower 5 through the descending entry section 6 and then leaving the descending tower 5 through the descending slide-out section 7 to return in the same direction, and the descending entry section 6 and the descending slide-out section 7 being in the same direction.

According to the invention, with players being seated thereon, the amusement ship may enter the lifting tower by the bow through the entry section, and then leave the lifting tower by the stern through the lifting slide-out section after being lifted to a certain height by the lifting tower, so as to return in the same direction; then the amusement ship enters the descending tower through the descending entry section and leaves the descending tower through the descending slide-out section after the amusement ship descends to a certain height from the descending tower, so as to return in the same direction; in this way, an innovative ascending, backwards-rushing and falling playing method is realized, and different experiences of lifting, backwards-rushing and weightlessness can be obtained within a short period of time, which greatly improves the amusement experience of players with various playing methods; and the design is novel, diversified playing methods are available, and interestingness is enhanced.

The center line of the entry section 2 of the present invention coincides with the center line of the lifting slide-out section 3, and the center line of the descending entry section 6 coincides with the center line of the descending slide-out section 7, so as to facilitate assembly.

The amusement ship 4 of the present invention comprises a ship body 41, wherein a chassis 42 provided with rollers 43 is disposed under the ship body 41. The invention may be provided with a driving motor which drives the rollers 43 to rotate through a tire chain transmission mechanism.

The lifting tower 1 of the present invention comprises a tower frame 11, wherein a lifting base 12 for lifting the amusement ship and a driving mechanism 13 for driving the lifting base to rise are arranged on the tower frame 11; and the lifting tower also comprises an anti-overturning mechanism 14 for preventing the amusement ship from overturning and an anti-falling safety mechanism 15 for preventing the amusement ship from falling. The tower frame 11 may be configured to slide up and down vertically in a straight line, so that the amusement ship 4 can be lifted vertically in a straight line on the tower frame 11, in this way, the experience of vertical lifting can be generated, greatly increasing the amusement experience of players.

The entry section 2 of the present invention may comprise an auxiliary lifting tower frame 21/auxiliary lifting tower frames 21 provided with an auxiliary lifting guide rail 22/auxiliary lifting guide rails 22 for the amusement ship to slide thereon, and the auxiliary lifting tower frame 21 slides/the auxiliary lifting tower frames 21 slide upward from the starting end to the end connected with a lifting tower system.

The entry section of the present invention may also be a sliding rail, and entry to the lifting tower system can be realized through the sliding rail.

The lifting slide-out section 3 of the present invention comprises a backwards-rushing frame 31 connected with the upper end of the lifting tower system, and the backwards-rushing frame 31 is provided with a backwards-rushing guide rail 32/backwards-rushing guide rails 32.

The descending tower 5 of the present invention comprises a descending frame 51, and the descending frame 51 is provided with a sliding frame 52 capable of falling on the descending frame and a driving device 53 for driving the sliding frame to fall. The descending frame 51 may be configured to slide up and down vertically in a straight line, so that the amusement ship 4 can descend vertically in a straight line on the descending frame 51, in this way, the experience of vertical falling can be generated, greatly increasing the amusement experience of players.

The descending entry section 6 of the present invention comprises a descending entry frame 61 provided with a descending entry guide rail 62/descending entry guide rails 62 for the amusement ship to slide thereon, and the descending entry frame 61 is linearly arranged from the starting end to the end connected with the descending tower 5; and the descending slide-out section 7 comprises a descending slide-out frame 71 provided with a slide-out guide rail 72/slide-out guide rails 72 for the amusement ship to slide thereon, and the descending slide-out frame 71 is arranged in a descending manner from the end connected with the descending tower 5 to the end away from the descending tower 5.

A driving motor 44 for driving the rollers and a tire chain transmission braking system 45 are also arranged on the auxiliary lifting guide rail 22/rails 22, the backwards-rushing guide rail 32/rails 32, the descending entry guide rail/rails 62 and the slide-out guide rail/rails 72 of the present invention.

What is claimed is:

1. An amusement device for ascending, backwards rushing and falling, comprising:

a lifting tower, the lower part of the lifting tower being provided with an entry section, the upper part of the lifting tower being provided with a lifting slide-out section, an amusement ship entering the lifting tower by the bow through the entry section and then leaving the lifting tower by the stern through the lifting slide-out section to return in the same direction, and the entry section and the lifting slide-out section being in the same direction;

and a descending tower, the upper part of the descending tower being provided with a descending entry section, the lower part of the descending tower being provided with a descending slide-out section, the amusement ship entering the descending tower through the descending entry section and then leaving the descending tower through the descending slide-out section to return in the same direction, and the descending entry section and the descending slide-out section being in the same direction, wherein the lifting slide-out section comprises a backwards-rushing frame connected with the upper end of the lifting tower, and the backwards-rushing frame is provided with a backwards-rushing guide rail/backwards-rushing guide rails.

2. The amusement device for ascending, backwards rushing and falling according to claim 1, wherein the center line of the entry section coincides with the center line of the lifting slide-out section.

3. The amusement device for ascending, backwards rushing and falling according to claim 1, wherein the center line of the descending entry section coincides with the center line of the descending slide-out section.

4. The amusement device for ascending, backwards rushing and falling according to claim 1, wherein the amusement ship comprises a ship body, a chassis provided with rollers is disposed under the ship body.

5. The amusement device for ascending, backwards rushing and falling according to claim 1, wherein the lifting tower comprises a tower frame, wherein a lifting base for lifting the amusement ship and a driving mechanism for driving the lifting base to rise are arranged on the tower frame; and the lifting tower also comprises an anti-overturning mechanism for preventing the amusement ship from overturning and an anti-falling safety mechanism for preventing the amusement ship from falling.

6. The amusement device for ascending, backwards rushing and falling according to claim 1, wherein the entry section comprise an auxiliary lifting tower frame/ auxiliary lifting tower frames which are provided with an auxiliary lifting guide rail/ auxiliary lifting guide rails for the amusement ship to slide thereon, and the auxiliary lifting tower frames slides/ auxiliary lifting tower frames slide upward from a starting end to an end connected with a lifting tower system.

7. The amusement device for ascending, backwards rushing and falling according to claim 1, wherein the entry section is a water flow passage passing through the lower part of the lifting tower, and water flow with a certain flow speed which can drive the amusement ship to enter the lower part of the lifting tower flows in the water flow passage.

8. The amusement device for ascending, backwards rushing and falling according to claim 1, wherein the descending tower comprises a descending frame, and the descending frame is provided with a sliding frame capable of falling on the descending frame and a driving unit for driving the sliding frame to fall.

9. The amusement device for ascending, backwards rushing and falling according to claim 1, wherein the descending entry section comprises a descending entry frame provided with a descending entry guide rail/descending entry guide rails for the amusement ship to slide thereon, and the descending entry frame is linearly arranged from the starting end to the end connected with the descending tower; and the descending slide-out section comprises a descending slide-out frame provided with a slide-out guide rail/slide-out guide rails for the amusement ship to slide thereon, and the descending slide-out frame is arranged in a descending manner from the end connected with the descending tower to the end away from the descending tower.

* * * * *